US006432224B1

(12) United States Patent
Minevski et al.

(10) Patent No.: US 6,432,224 B1
(45) Date of Patent: Aug. 13, 2002

(54) ISOMOLYBDATE CONVERSION COATINGS

(75) Inventors: Zoran Minevski, The Woodlands; Jason Maxey, College Station; Carl Nelson, Bryan; Cahit Eylem, College Station, all of TX (US)

(73) Assignee: Lynntech, Inc., College Station, TX (US)

( * ) Notice: Subject to any disclaimer, the term of this patent is extended or adjusted under 35 U.S.C. 154(b) by 0 days.

(21) Appl. No.: 09/500,372

(22) Filed: Feb. 8, 2000

(51) Int. Cl.[7] ..... C23C 22/83

(52) U.S. Cl. ..... 148/272; 148/273; 148/276; 148/285; 427/327; 427/328; 427/343

(58) Field of Search ..... 148/272, 273, 148/276, 285; 427/327, 328, 343

(56) References Cited

U.S. PATENT DOCUMENTS

| | | | | |
|---|---|---|---|---|
| 3,365,313 A | | 1/1968 | Roberts, Jr. | |
| 3,960,676 A | | 6/1976 | Miyosawa | |
| 3,962,061 A | * | 6/1976 | Nikaido et al. | 205/704 |
| 4,435,256 A | | 3/1984 | Deininger | |
| 4,435,257 A | | 3/1984 | Deininger | |
| 4,451,338 A | | 5/1984 | Deininger | |
| 4,551,326 A | | 11/1985 | Thompson | |
| 4,606,843 A | | 8/1986 | Kaezur | |
| 4,755,224 A | | 7/1988 | Bibber | |
| 4,828,615 A | | 5/1989 | Cape | |
| 4,878,963 A | | 11/1989 | Bibber | |
| 5,217,584 A | | 6/1993 | Deininger | |
| 5,637,143 A | | 6/1997 | Jenkins | |
| 5,746,994 A | | 5/1998 | Johnson | |

FOREIGN PATENT DOCUMENTS

DK EP 0 724 653 B1 11/1992

OTHER PUBLICATIONS

K. Bouzek, I. Rousar, Influence of anode material on current yields during ferrate (vi) production by anodic iron dissolution Part I: Current efficiency during anodic dissolution of grey cast iron to ferrate (vi) in concentrated alkali hydroxide solutions, revised Nov. 28, 1995 pp. 919 to 923.

K. Bouzek, I Rousar, M.A. Taylor, Influence of anode material on current yields during ferrate (vi) production by anodic from dissolution Part II, Current efficiency during anodic dissolution white cast iron to ferrate (iv) in concentrated alkali hydroxide solutions, revised Jan. 11, 1996 pp. 925–931.

K. Bouzek, I Rousar, Current efficiency during anodic dissolution of iron to ferrate (vi) in concentrated alkali hydroxide solutions revised Apr., 23, 1993 pp. 1317–1322.

(List continued on next page.)

*Primary Examiner*—John Sheehan
*Assistant Examiner*—Andrew L. Oltmans
(74) *Attorney, Agent, or Firm*—Streets & Steele; Jeffrey L. Streets

(57) ABSTRACT

A conversion coating solution and process forms a stable and corrosion-resistant layer on metal substrates or layers or, more preferably, on a boehmite layer or other base conversion coating. The conversion coating process involves contacting the substrate, layer or coating with an aqueous alkali metal isomolybdate solution in order to convert the surface of the substrate, layer or coating to a stable conversion coating. The aqueous alkali metal molybdates are selected from sodium molybdate ($Na_2MoO_4$), lithium molybdate ($Li_2MoO_4$), potassium molybdate ($K_2MoO_4$), or combinations thereof, with the most preferred alkali metal molybdate being sodium molybdate. The concentration of alkali metal molybdates in the solution is preferably less than 5% by weight. In addition to the alkali metal molybdates, the conversion coating solution may include alkaline metal passivators selected from lithium nitrate ($LiNO_3$), sodium nitrate ($NaNO_3$), ammonia nitrate ($NH_4NO_3$), and combinations thereof; lithium chloride, potassium hexafluorozirconate ($K_2ZrF_6$) or potassium hexafluorotitanate ($K_2TiF_6$).

32 Claims, 2 Drawing Sheets

OTHER PUBLICATIONS

A. Denvir, D. Pletcher, Electrochemical generation of ferrate Part I: Dissolution of an iron wool bed anode, revised Oct. 31, 1995 pp. 815–821.

A. Denvir, D. Pletcher, Electrochemical generation of ferrate Part 2: Influence of anode composition revised Oct. 31, 1995 pp. 823–827.

Lionel Delaude and Pierre Laszlo, A Novel Oxidizing Reagent Based on Potassium Ferrate (VI) Apr. 5, 1996 pp. 6360–6370.

Henry J. Hrostowski and Allen B. Scott, The Magnetic Susceptibility of Potassium Ferrate, Jun. 10, 1949. pp. 105–107.

G.W. Thompson, L.T. Ockerman and J.M. Schreyer, Preparation and Purification of Potassium Ferrate VI, Aug. 9, 1950, pp. 1379–1381.

* cited by examiner

| Corresponding Example | Boehmite | Conversion Solution* | | Post-Sealants | | Corrosion Performance |
|---|---|---|---|---|---|---|
| | | Main Component (wt%) | Additives (wt%) | $Ca(OH)_2$ | Silicate | Salt Fog Results (days) |
| 1 | YES | no conversion step | | NO | NO | 1 |
| 2 | YES | 3% $Na_2MoO_4$ | NONE | NO | NO | 2 |
| 3 | YES | 1.5% $Na_2MoO_4$ | 1.5% $KMnO_4$ | NO | NO | 2 |
| 3 | YES | 1.5% $Na_2MoO_4$ | 1.5% $KMnO_4$<br>0.5% LiCl<br>0.5% $LiNO_3$ | NO | NO | 3 |
| 4 | YES | 3% $Na_2MoO_4$ | NONE | YES | YES | 21 |
| 4 | YES | 3% $K_2MoO_4$ | NONE | YES | YES | 5 |
| 4 | YES | 3% $Li_2MoO_4$ | NONE | YES | YES | 3 |
| 5 | NO | 1.5% $Na_2MoO_4$ | 1.5% $KMnO_4$<br>0.5% LiCl<br>0.5% $LiNO_3$ | YES | YES | 3 |
| 5 | YES | 1.5% $Na_2MoO_4$ | 1.5% $KMnO_4$ | YES | YES | 18 |
| 5 | YES | 1.5% $Na_2MoO_4$ | 1.5% $KMnO_4$<br>0.5% LiCl | YES | YES | 19 |
| 5 | YES | 1.5% $Na_2MoO_4$ | 1.5% $KMnO_4$<br>0.5% $LiNO_3$ | YES | YES | 15 |
| 5 | YES | 1.5% $Na_2MoO_4$ | 1.5% $KMnO_4$<br>0.5% LiCl<br>0.5% $LiNO_3$ | YES | YES | 20 |
| 5 | YES | 1.5% $Na_2MoO_4$ | 1.5% $KMnO_4$<br>0.5% $LiCO_3$ | YES | YES | 2 |
| 5 | YES | 3% $Na_2MoO_4$ | 0.5% LiCl<br>0.5% $LiNO_3$<br>1% $K_2ZrF_6$<br>0.5% $K_2TiF_6$ | YES | YES | 14 |
| 5 | YES | 1.5% $Na_2MoO_4$ | 1.5% $KMnO_4$<br>0.5% LiCl<br>0.5% $LiNO_3$<br>1% $K_2ZrF_6$<br>0.5% $K_2TiF_6$ | YES | YES | 7 |
| 5 | YES | 3% $Na_2MoO_4$ | 0.5% LiCl<br>0.5% $LiNO_3$<br>0.5% $NaNO_3$ | YES | YES | 14 |
| 5 | YES | 3% $Na_2MoO_4$ | 0.5% LiCl<br>0.5% $LiNO_3$<br>0.5% $NH_4NO_3$ | YES | YES | 2 |
| 5 | YES | 1.5% $Na_2MoO_4$ | 1.5% $KMnO_4$<br>0.5% LiCl<br>0.5% $LiNO_3$<br>0.5% $Na_2SiF_6$ | YES | YES | 2 |
| 5 | YES | 1.5% $Na_2MoO_4$ | 1.5% $KMnO_4$<br>0.5% LiCl<br>0.5% $LiNO_3$<br>0.5% $K_2ZrF_6$<br>0.5% $Na_3PO_4$ | YES | YES | 7 |

Figure 1

| | | | | | | |
|---|---|---|---|---|---|---|
| 5 | YES | 1.5% $Na_2MoO_4$ | 1.5% $KMnO_4$<br>0.5% LiCl<br>0.5% $LiNO_3$<br>0.5% $K_2ZrF_6$<br>0.5% $Na_4P_2O_7$ | YES | YES | 7 |

*All conversion coatings were applied for 2 minutes at 80°C.

Figure 1 – Molybdate Conversion Coatings Continued

ISOMOLYBDATE CONVERSION COATINGS

This invention was made with Government support under contract NAS10-97003 awarded by NASA. The Government has certain rights in this invention.

BACKGROUND OF THE INVENTION

1. Field of the Invention

The present invention relates to a method and solution for forming or enhancing the properties, such as corrosion resistance, of a conversion coating on metal surfaces or substrates.

2. Background of the Related Art

In general, chemical conversion coatings are formed chemically by causing the surface of the metal to be "converted" into a tightly adherent coating, where either all or part of the conversion coating consists of an oxidized form of the substrate metal. Chemical conversion coatings can provide high corrosion resistance to the substrate as well as strong bonding affinity for paint. The industrial application of paint to metals generally requires the use of a chemical conversion coating, particularly when the performance demands are high.

Although aluminum protects itself against corrosion by forming a natural oxide coating, the protection is not complete. In the presence of moisture and electrolytes, aluminum alloys, particularly aluminum alloys with a high copper content, corrode much more rapidly than pure aluminum.

In general, there are two types of processes for treating aluminum to form a beneficial conversion coating. The first is by anodic oxidation (anodization) in which the aluminum component is immersed in a chemical bath, such as a chromic or sulfuric acid bath, and an electric current is passed through the aluminum component and the chemical bath. The conversion coating formed on the surface of the aluminum component offers resistance to corrosion and a bonding surface for organic finishes.

The second type of process is by chemically producing a conversion coating, which is commonly referred to as a chemical conversion coating, by subjecting the aluminum component to a chemical solution, such as a chromic acid solution, but without using an electric (current in the process. The chemical solution may be applied by immersion application, by manual application, or by spray application. The resulting conversion coating on the surface of the aluminum component offers resistance to corrosion and a bonding surface for organic finishes.

Chromate based conversion coatings have been widely used in applications where maximum corrosion protection is an issue. Immersion of aluminum or aluminum alloys in a chromate conversion coating bath results in a thick, corrosion resistant film consisting of hydrated Cr(III) and Al(III) oxides. The reaction is driven by reduction of the high valent Cr(VI) ion and oxidation of the Al metal. Some of the benefits of a chromate conversion coating include hydrophobicity and self-healing properties.

Many aluminum structural parts, as well as Cd plated, Zn plated, Zn-Ni plated, and steel parts, throughout the aircraft and aerospace industry are currently being treated using this chromic acid process technology. Chromic acid conversion films, as formed on aluminum substrates, have been shown to meet a 168-hour corrosion resistance criterion, but they primarily serve as a surface substrate for paint adhesion. Because of their relative thinness and low coating weights (40–150 milligrams/ft$^2$), chromic acid conversion coatings do not reduce the fatigue life of the aluminum structure.

However, environmental regulations in the United States, particularly in California, and in other countries are drastically reducing the levels of hexavalent chromium compounds permitted in effluents and emissions from metal finishing processes. Accordingly, chemical conversion coating processes employing hexavalent chromium compounds need to be replaced.

Some of the most investigated non-chromate conversion coatings used in the treatment of aluminum alloy-based materials are described as follows. Sol-Gel technology uses polymers or metal oxides either alone or mixed to form complexes by the hydrolysis of appropriate precursor compounds. Sol-Gels can form powders or thin films that inhibit corrosion on substrates.

Fluorozirconium coating technology uses complexed transition metal salts to create a thin film on a substrate material similar to a conversion coating. Specifically, zirconium is mixed with fluorine to create fluorozirconium, which reacts with the part surface to form a coating.

Cobalt-based coatings use cobalt and molybdenum to treat substrate materials. The coatings created are low in electrical resistance and are good for corrosion resistance.

Rare Earth Metal (REM) salts may be applied by heated immersion to create protective layers con substrate materials. REMs provide corrosion resistance by producing a protective oxide film.

Potassium permanganate solutions can be used to create manganese oxide films on substrates. Manganese oxide films resulting from potassium permanganate treatment closely match the corrosion resistance of traditional chromic oxide films used in conversion coatings. Potassium permanganate coatings can be very effective in protecting aluminum alloys.

Fluotitanic coatings, deposited from acid solutions with organic polymers, require few process steps, and can usually be done at ambient temperatures. Although these coatings have been widely used in a variety of applications, they have not been used in the aerospace industry.

Talc coatings, which are typically applied to aluminum substrates, are resistant to corrosion. These polycrystalline coatings are applied by precipitating aluminum-lithium compounds and other anions in an alkaline salt solution.

Anodizing is a process in which a metal surface is converted to an oxide layer, producing a tough, adherent surface layer. A thick oxide layer can be produced by immersing a part in an electrolytic solution and passing an electrical current through it, similar to electroplating. Then, by placing the part in boiling water, the film's pores can be sealed. As a result, the oxide changes from one form to another.

Despite these alternatives, there is a continuing need for a conversion coating solution that will form a stable, corrosion-resistant conversion coating on metal surfaces without containing or producing toxic chemicals. Additionally, it would be desirable if the conversion coating provided a suitable surface for receiving organic coatings or paints.

SUMMARY OF THE INVENTION

The present invention provides a method for producing a conversion coating on a metal surface, such as aluminum, aluminum alloys, and ferrous metals. The method comprises forming a layer of boehmite on the metal surface, such as by exposing the metal surface to boiling water or anodizing the metal surface, and subjecting the layer of boehmite to an aqueous solution having an alkali metal molybdate selected from sodium molybdate, lithium molybdate, potassium molybdate, and combinations thereof to form the conversion coating. The boehmite layer is subjected to the aqueous alkali metal molybdate solution at a temperature between ambient and boiling, preferably between 60° C. and 80° C. and for a period of between 1 and 20 minutes.

The boehmite layer is subjected to the aqueous alkali metal molybdate solution by submersing, spraying, brushing or combinations thereof. The concentration of alkali metal molybdates in the aqueous solution is preferably less than 5% by weight, more preferably between 1% and 3% by weight, and even more preferably about 3% by weight. The aqueous solution may further comprise one or more alkaline metal passivators selected from lithium nitrate ($LiNO_3$), sodium nitrate ($NaNO_3$), ammonia nitrate ($NH_4NO_3$), and combinations thereof. Activators, such as lithium chloride or lithium fluoride, may also be included. Additionally, the solution may include an additive selected from potassium hexafluorozirconate ($K_2ZrF_6$), potassium hexafluorotitanate ($K_2TiF_6$), and combinations thereof. The resulting aqueous alkali metal molybdate solution preferably has a pH between about 7 and about 12.

Preferably, the conversion coating is treated with an aqueous calcium hydroxide solution prepared by combining calcium hydroxide with an aqueous solution having less than 1.73 grams of carbon dioxide per liter, preferably less than 0.85 grams per liter, and more preferably less than 0.45 grams per liter. The conversion coating is contacted with an aqueous calcium hydroxide solution for between about 1 and about 20 minutes, at a temperature between about 25 and about 100° C. The aqueous calcium hydroxide solution has a calcium hydroxide concentration up to saturation, preferably between about 0.015 and about 0.15% by weight, and more preferably between about 0.06 and about 0.09% by weight.

The invention may further comprise subjecting the conversion coating to an aqueous post treatment solution having one or more compounds selected from alkali metal silicates, alkali metal borates, alkali metal phosphates, lithium nitrates, or combinations thereof, wherein the concentration of the one or more compounds is between about 0.1% and about 5% by weight. Preferably, the conversion coating is subjected to the aqueous post treatment solution at a solution temperature between about 10° C. and about 100° C., and for a period of between about 1 minute and about 20 minutes.

BREIF DESCRIPTION OF THE DRAWINGS

So that the above recited features and advantages of the present invention can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

FIG. 1 is a table showing the results of Examples 1–5 under various conditions.

DETAILED DESCRIPTION OF THE INVENTION

Figure 2:
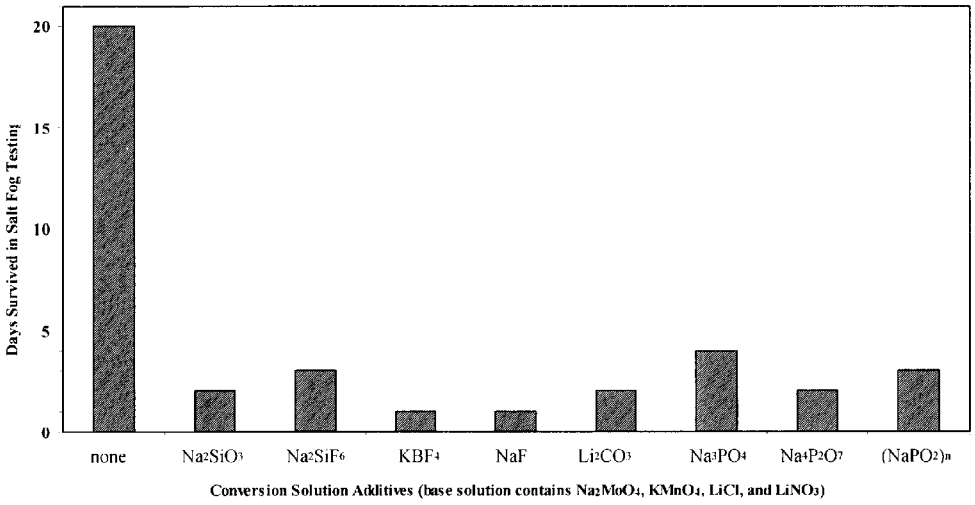
FIG. 2 is a bar chart showing the relative detrimental effect of certain additives on the corrosion resistance of molybdate conversion coatings.

The present invention provides a conversion coating solution and process that forms a stable and corrosion-resistant layer on metal substrates or layers or, more preferably, on a boehmite layer or other base conversion coating. Particularly, the conversion coating process involves contacting the substrate, layer or coating with an aqueous alkali metal isomolybdate solution in order to convert the surface of the substrate, layer or coating to a stable conversion coating.

Optionally, yet preferably, the metallic surface of the substrate is pre-treated before being contacted with the aqueous alkali metal isomolybdate conversion coating solution. Most preferably, the metal surface is cleaned by sonicating in acetone for 30 minutes, then cleaned in an alkaline solution. The cleaned metal surface may then be immersed in a deoxidizing solution such as LNC deoxidizer (Oakite Products Inc., Berkeley Heights N.J.) to remove any residual oxide film from the metal surface.

Following pre-treatment or pre-cleaning, if any, a layer of boehmite is formed on the metal surface, preferably by exposing the metal to boiling water or anodization. Most preferably, the boehmite layer is formed in boiling deionized water at 100° C. for 20 minutes. The boehmite layer is then subjected to an aqueous alkali metal isomolybdate conversion coating solution of the present invention.

The conversion coating solutions of the present invention comprising aqueous solutions of alkali metal molybdates, preferably sodium molybdate ($Na_2MoO_4$), lithium molybdate ($Li_2MoO_4$), potassium molybdate ($K_2MoO_4$), or combinations thereof, with the most preferred alkali metal molybdate being sodium molybdate. The concentration of alkali metal molybdates in the solution is preferably less than 5%, more preferably between 1% and 3%, and most preferably about 3% by weight. The aqueous alkali metal molybdate solutions may be used at a temperature of between ambient (typically about 25° C.) and boiling (about 100° C.), preferably between 25° C. and 80° C., and most preferably between about 60° C. to 80° C. The boehmite layer is subjected to the aqueous alkali metal molybdate solution for a period of between 1 and 20 minutes, preferably about 2 to 5 minutes.

In addition to the alkali metal molybdates, the conversion coating solution may include a number of additives. Specifically, the solution may include alkaline metal passivators selected from lithium nitrate ($LiNO_3$), sodium nitrate ($NaNO_3$), ammonia nitrate ($NH_4NO_3$), and combinations thereof, with the preferred alkaline metal passivator being lithium nitrite. Activators, such as lithium chloride, may also be used in the conversion coating solution. The solution may also include potassium hexafluorozirconate ($K_2ZrF_6$) or potassium hexafluorotitanate ($K_2TiF_6$). Other and further additives may be used in the conversion coating solutions as should be apparent by those with skill In the art.

However, it has been found that certain other additives to the aqueous alkali metal molybdate solution are detrimental to the salt for corrosion resistance of the conversion coating formed by the solution. The detrimental additives, such as sodium metasilicate as disclosed and used in the conversion coating solutions of Miller in U.S. Pat. No. 5,399,210, should not be used in the conversion coating solutions. Accordingly, the aqueous alkali metal conversion coating solutions of the present invention should be prepared without these additives and should be substantially free of these additives. Salt fog chamber test results for conversion coatings formed from aqueous sodium molybdate solutions with and without these detrimental additives are shown in FIG. 2.

Preferably, the conversion coating formed by the aqueous alkali metal isomolybdate solution is subsequently treated with an aqueous calcium hydroxide solution. In order to achieve the full benefits of this treatement, it is critical to avoid forming carbonates in the calcium hydroxide solution as the result of calcium hydroxide reacting with carbon dioxide. This critical objective is most preferably achieved by preparing the calcium hydroxide solution using water or an aqueous solution having a carbon dioxide concentration that is less than equilibrium amounts of carbon dioxide at ambient temperature. Accordingly, water or aqueous solutions that contain carbon dioxide must be processed to remove some, all or substantially all of the carbon dioxide in the water or aqueous solution before introducing the calcium hydroxide.

The concentration of carbon dioxide in water may be reduced through any known process, but is preferably reduced by heating the water, most preferably to a temperature between about 50° C. and about 100° C. Other processes for reducing the carbon dioxide concentration in water include passing the water through an electroosmotic pump or passing the carbon dioxide through a hydrophobic membrane. It is important that the carbon dioxide content of the water be reduced, since the amount of carbon dioxide present in water at room temperature will yield a solution that does not produce the desired corrosion protection. While water exposed to air typically contains diffused carbon dioxide gas at a concentration of about 1.73 grams per liter of water, it is preferred to reduce the carbon dioxide concentration to below 0.85 g/L, and more preferably below 0.45 g/L.

The calcium hydroxide solution is applied into contact with the conversion coating surfaces that have already been formed or induced on a metal substrate or layer by the isomolybdate solution. While applying calcium hydroxide solutions in this second manner has sometimes been referred to as a "post-treatment", the solutions and processes of the present invention may also be referred to as sealants or any other term so long as they enhance or modify properties of the existing oxide or conversion coating layers. Specifically, the calcium hydroxide solutions and processes have been found to enhance or modify the corrosion resistance and reduce the porosity of the resulting layer. The terms "metal", "metal substrate" and "metal layer" include, but are not limited to, individual metals and alloys or combinations of metals.

The calcium hydroxide concentration may be any concentration, preferably up to saturation, more preferably between about 0.015% and about 0.15% by weight, and most preferably between about 0.06 and about 0.15% by weight. The calcium hydroxide solutions are preferably used at a solution temperature between about ambient or room temperature (typically about 25° C.) and about the boiling point of the aqueous solution (typically about 100° C.). The contact time between the calcium hydroxide solution and the substrate may be of any effective duration, but is preferably between about 1 and about 20 minutes. The calcium hydroxide solution may further comprise up to about 5% by weight of a sealant selected from an alkali metal silicate, an alkali metal borate, an alkali metal phosphate, or lithium nitrate. Optionally, the aqueous calcium hydroxide solution may further include manganese, molybdenum or a combination thereof that form stable coatings that act as inhibitors to corrosion of the coatings.

The solutions and processes of the present invention may be used in association with metal substrates selected from aluminum, aluminum alloys, steels (e.g., carbon steels and stainless steels), and other ferrous metals. Where the terms "aluminum" and "aluminum alloys" are used herein, they should be interpreted to be inclusive of each other, i.e. "aluminium" does not exclude aluminum alloys, unless the description specifically states otherwise.

It is also optional to carry out the process of contacting a substrate with the calcium hydroxide solutions disclosed herein while maintaining an inert atmosphere or environment, or perhaps a vacuum, around the process to avoid carbon dioxide from the air being absorbed into the solution and/or reacted with the calcium hydroxide. Any inert gas known in the art may be used for this purpose, particularly including argon or nitrogen. Other methods of excluding or reducing carbon dioxide exposure may also be used. It is also anticipated that an inert atmosphere or vacuum may be maintained over a calcium hydroxide solution between preparation and application to a substrate, whether the period of storage is a few minutes or more than a day.

It is also optional to contact the molybdate conversion coating surface with a post treatment solution containing one or more compounds selected from an alkali metal silicate, an alkali metal borate, an alkali metal phosphate, lithium nitrate, or mixtures thereof. Preferably, the concentration of the one or more compounds is between about 0.1% and about 5% by weight. The post treatment is preferably conducted at a solution temperature between about 10° C. and about 100° C. for a period of between about 1 minute and about 20 minutes.

EXAMPLES

The following examples of the present invention show the function of the invention and disclose some of its preferred embodiments. These examples are not to be taken as limiting the scope of the invention to the steps described therein, as the invention may include other steps and conditions. Except where indicated, aluminum panels measuring 1.5 inches by 2 inches were used in the following examples, and all amounts are percentages by weight.

Example 1

This example describes the pre-treatment of the aluminum panels. Prior to contacting the aluminum panels with an aqueous chemical conversion coating solution, the panels were degreased and prepared by sonication in acetone for 30 minutes. They were then cleaned with an alkaline cleaning solution (such as 4215 NCLT available from Elf Atochem—Turco Products Division, Westminister, Calif.), for 10 minutes at 60° C. The panels were then rinsed with deionized water and treated with a deoxidizing solution of 15% LNC deoxidizer (Oakite Products Inc., Berkeley Heights, N.J.) for 10 minutes at 25° C. The panels were then immersed in boiling water for 20 minutes and coated with a thin layer of boehmite of a general formula $AlO_x(OH)_y$.

Example 2

This example describes the treatment of the aluminum panels with an aqueous chemical conversion coating solution containing only molybdate compounds. Aqueous chemical conversion coating solutions of molybdate having concentrations between about 1.0% and 5.0% were prepared, and the aluminum panels pre-treated as described in Example 1 were immersed in the solution for 1 to 5 minutes at different temperatures ranging from 25° C. to 80° C. The panels were then rinsed thoroughly with deionized water, dried in air for 48 hours and tested by exposure in a salt-fog chamber according to ASTM Method B-117.

Example 3

This example describes the treatment of the aluminum panels with conversion coating solutions containing molybdate compounds in a combination of one or more compounds such as chlorides, nitrates, phosphates, borates, silicates, fluorides or metal oxides. Aqueous solutions of molybdate having concentrations in the range from 1.0% to 5.0% and one or more additives with concentrations from 0.1% to 3.0% were prepared. The aluminum panels prepared as described in Example 1 were immersed in these solutions for 1 to 5 minutes at different temperatures from 25° C. to 80° C. The panels were then rinsed thoroughly with deionized water, dried in air for 48 hours and tested by exposure to a salt-fog chamber in accordance with ASTM Method B-117.

Example 4

This example describes the post-treatment of the coated substrates to enhance and preserve performance of the chemical conversion coating. An aqueous solution of molybdate having concentrations in the range from 1.0% to 5.0% by weight. The substrate panels prepared as described in Example 1 were immersed in the prepared solutions for two minutes at different temperatures from 50° C. to 80° C. The panels were rinsed thoroughly with deionized water and then received post-treatment by being immersed in an aqueous solution containing 0.09% by weight calcium hydroxide and 0.6% by weight lithium nitrate at 100° C. for 20 minutes. They were finally dried in air for 48 hours and tested by exposure to a salt-fog chamber in accordance with ASTM Method B-117.

Example 5

This example describes the post-treatment of the coated substrates to enhance and preserve performance of the chemical conversion coating. An aqueous solution of molybdate having concentrations in the range from 1.0% to 5.0% by weight and one or more additives with concentrations of 0.1% to 3.0% were prepared. The substrate panels prepared as described in Example 1 were immersed in the prepared solutions for two minutes at different temperatures from 50° C. to 80° C. The panels were rinsed thoroughly with deionized water and then received post-treatment by being immersed in an aqueous solution containing 0.09% by weight calcium hydroxide and 0.6% by weight lithium nitrate at 100° C. for 20 minutes. They were finally dried in air for 48 hours and tested by exposure to a salt-fog chamber in accordance with ASTM Method B-117.

Example 6

This example further describes the post-treatment of the coated substrates to enhance and preserve performance of the chemical conversion coating. Panels prepared as described in Example 4 and Example 5 are optionally exposed to an aqueous solution containing 2.4% by weight alkali metal silicate at 60° to 80° C. for 1 to 5 minutes. They were then dried in air for 48 hours and tested by exposure to a salt-fog chamber in accordance with ASTM Method B-117.

The compositions of the solutions used in the foregoing examples are present in FIG. 1 along with the results of corrosion tests for each of the examples.

As used herein, the singular form of a term shall be taken to include the plural form of the term, unless specifically stated otherwise. For example, terms such as "a", "an" and "the" used in association with a component of the invention shall be taken to mean "one or more" unless it is specifically stated that there should be only one component.

While the foregoing is directed to the preferred embodiment of the present invention, other and further embodiments of the invention may be devised without departing from the basic scope thereof, and the scope thereof is determined by the claims which follow.

We claim:

1. A method for producing a conversion coating on a metal surface, comprising;

forming a layer of boehmite on a metal surface;

subjecting the layer of boehmite to an aqueous solution in the absence of electrolysis, the aqueous solution having an alkali metal molybdate selected from sodium molybdate, lithium molybdate, potassium molybdate, and combinations thereof to form the conversion coating.

2. The method of claim 1, wherein the step of forming a layer of boehmite further comprise a process selected from exposing the metal surface to boiling water and anodization of the metal surface.

3. The method of claim 1, wherein the aqueous alkali metal molybdate solution has a pH between about 7 and about 12.

4. The method of claim 1, wherein the step of subjecting the boehmite layer to the aqueous alkali metal molybdate solution comprises a process selected from submersing, spraying, brushing and combinations thereof.

5. The method of claim 1, wherein the metal surface is selected from aluminum, aluminum alloys, copper, iron, and combinations thereof.

6. The method of claim 1, wherein the metal surface comprises a metal selected from aluminum, aluminum alloys, and ferrous metals.

7. A method for producing a conversion coating on a metal surface, comprising:

forming a layer of boehmite on a metal surface, wherein the metal surface is steel;

subjecting the layer of boehmite to an aqueous solution having an alkali metal molybdate selected from sodium molybdate, lithium molybdate, potassium molybdate, and combinations thereof to form the conversion coating.

8. A method for producing a conversion coating on a metal surface, comprising:

forming a layer of boehmite on a metal surface;

subjecting the layer of boehmite to an aqueous solution having an alkali metal molybdate selected from sodium molybdate, lithium molybdate, potassium molybdate, and combinations thereof to form the conversion coating; and treating the conversion coating with an aqueous calcium hydroxide solution prepared by combining calcium hydroxide with an aqueous solution having less than 1.73 grams of carbon dioxide per liter.

9. The method of claim 8, wherein the aqueous solution has a carbon dioxide concentration less than 0.85 grams per liter.

10. The method of claim 8, wherein the aqueous solution has a carbon dioxide concentration less than 0.45 grams per liter.

11. A method for producing a conversion coating on a metal surface, comprising:

forming a layer of boehmite on a metal surface; and subjecting the layer of boehmite to an aqueous solution having an alkali metal molybdate selected from sodium molybdate, lithium molybdate, potassium molybdate, and combinations thereof to form the conversion coating, wherein the conversion coating is contacted with an aqueous calcium hydroxide solution for between about 1 and about 20 minutes.

12. The method of claim 11, wherein the aqueous calcium hydroxide solution has a temperature between about 25 and about 100° C.

13. The method of claim 11, wherein the aqueous calcium hydroxide solution has a calcium hydroxide concentration up to saturation.

14. The method of claim 11, wherein the aqueous calcium hydroxide solution has a calcium hydroxide concentration between about 0.015 and about 0.15% by weight.

15. The method of claim 11, wherein the aqueous calcium hydroxide solution has a calcium hydroxide concentration between about 0.06 and about 0.09% by weight.

16. The method of claim 11, wherein the aqueous calcium hydroxide solution is substantially free of carbonates.

17. The method of claim 8, further comprising the step of sparging the aqueous solution using an inert gas.

18. The method of claim 8, further comprising the step of exposing the aqueous solution to a vacuum environment.

19. The method of claim 8, further comprising the step of heating the aqueous solution to a temperature between 50 and 100° C.

20. The method of claim 1, wherein the concentration of alkali metal molybdates in the aqueous solution is less than 5% by weight.

21. The method of claim 1, wherein the concentration of alkali metal molybdates in the aqueous solution is between 1% and 3% by weight.

22. The method of claim 1, wherein the concentration of alkali metal molybdates in the aqueous solution is about 3% by weight.

23. A method for producing a conversion coating on a metal surface, comprising:

forming a layer of boehmite on a metal surface; and subjecting the layer of boehmite to an aqueous solution having an alkali metal molybdate selected from sodium molybdate, lithium molybdate, potassium molybdate, and combinations thereof to form the conversion coating, wherein the aqueous solution further comprises one or more alkaline metal passivators selected from lithium nitrate ($LiNO_3$), sodium nitrate ($NaNO_3$), ammonia nitrate ($NH_4NO_3$), and combinations thereof.

24. A method for producing a conversion coating on a metal surface, comprising:

forming a layer of boehmite on a metal surface; and subjecting the layer of boehmite to an aqueous solution having an alkali metal molybdate selected from sodium molybdate, lithium molybdate, potassium molybdate, and combinations thereof to form the conversion coating, wherein the aqueous solution further comprises activators such as lithium chloride or lithium fluoride.

25. A method for producing a conversion coating on a metal surface, comprising:

forming a layer of boehmite on a metal surface; and subjecting the layer of boehmite to an aqueous solution having an alkali metal molybdate selected from sodium molybdate, lithium molybdate, potassium molybdate, and combinations thereof to form the conversion coating, wherein the aqueous solution further comprises an additive selected from potassium hexafluorozirconate ($K_2ZrF_6$), potassium hexafluorotitanate ($K_2TiF_6$), and combinations thereof.

26. A method for producing a conversion coating on a metal surface, comprising:

forming a layer of boehmite on a metal surface;

subjecting the layer of boehmite to an aqueous solution having an alkali metal molybdate selected from sodium molybdate, lithium molybdate, potassium molybdate, and combinations thereof to form the conversion coating; and subjecting the conversion coating to an aqueous post treatment solution having one or more compounds selected from alkali metal silicates, alkali metal borates, alkali metal phosphates, lithium nitrates, or combinations thereof.

27. The method of claim 26, wherein the concentration of the one or more compounds is between about 0.1% and about 5% by weight.

28. The method of claim 26, wherein the conversion coating is subjected to the aqueous post treatment solution at a solution temperature between about 10° C. and about 100° C.

29. The method of claim 26, wherein the conversion coating is subjected to the aqueous post treatment solution for a period of between about 1 minute and about 20 minutes.

30. The method of claim 1, wherein the boehmite layer is subjected to the aqueous alkali metal molybdate solution at a temperature between ambient and boiling.

31. The method of claim 1, wherein the boehmite layer is subjected to the aqueous alkali metal molybdate solution at a temperature between 60° C. and 80° C.

32. The method of claim 1, wherein the boehmite layer is subjected to the aqueous alkali metal molybdate solution for a period of between 1 and 20 minutes.

* * * * *